US006857653B2

(12) United States Patent
Wilson

(10) Patent No.: US 6,857,653 B2
(45) Date of Patent: Feb. 22, 2005

(54) GLIDING SKIS

(75) Inventor: Anton F. Wilson, 774 Mays Blvd., #10 PMB 302, Incline Village, NV (US) 89451

(73) Assignee: Anton F. Wilson, Croton-on-Hudson, NY (US)

( * ) Notice: Subject to any disclaimer, the term of this patent is extended or adjusted under 35 U.S.C. 154(b) by 8 days.

(21) Appl. No.: 10/286,643

(22) Filed: Oct. 31, 2002

(65) Prior Publication Data

US 2004/0084879 A1 May 6, 2004

(51) Int. Cl.[7] ..... A63C 5/04
(52) U.S. Cl. ..... 280/602; 280/608; 280/609
(58) Field of Search ..... 280/601, 607, 280/608, 609, 644, 11.15, 11.18, 617, 28.15, 28.16, 602

(56) References Cited

U.S. PATENT DOCUMENTS

| | | | | |
|---|---|---|---|---|
| 382,254 A | | 5/1888 | Conradson | |
| 4,700,967 A | * | 10/1987 | Meatto et al. | 280/609 |
| 4,715,612 A | * | 12/1987 | Fels et al. | 280/609 |
| 4,957,304 A | * | 9/1990 | Diard et al. | 280/609 |
| 5,083,810 A | * | 1/1992 | Minidis | 280/608 |
| 5,242,187 A | * | 9/1993 | Diard et al. | 280/609 |
| 5,303,949 A | * | 4/1994 | Harper et al. | 280/608 |
| 5,360,229 A | | 11/1994 | Arduin et al. | |
| 5,405,161 A | | 4/1995 | Petkov | |
| 5,553,884 A | | 9/1996 | Abondance | |
| 5,647,353 A | | 7/1997 | Juhasz | |
| 5,671,939 A | | 9/1997 | Pineau | |
| 5,727,807 A | | 3/1998 | Krafft et al. | |
| 5,820,154 A | | 10/1998 | Howe | |
| 5,836,604 A | | 11/1998 | Piegay | |
| 5,871,223 A | * | 2/1999 | Zanco | 280/607 |
| 5,876,056 A | | 3/1999 | Karlsen | |
| 5,915,719 A | | 6/1999 | Bauvois | |
| 5,927,743 A | | 7/1999 | Mantel | |
| 5,984,344 A | | 11/1999 | Harsanyi et al. | |
| 6,079,746 A | | 6/2000 | Olsen | |
| 6,158,747 A | | 12/2000 | Magnani | |
| 6,182,998 B1 | | 2/2001 | Huyghe et al. | |
| 6,193,262 B1 | | 2/2001 | Silva | |
| 6,217,055 B1 | | 4/2001 | Silva | |
| 6,227,558 B1 | | 5/2001 | Arduin et al. | |
| 6,241,272 B1 | | 6/2001 | Hammerle | |
| 6,244,616 B1 | | 6/2001 | Arduin et al. | |
| 6,257,612 B1 | | 7/2001 | Zanco et al. | |
| 6,257,620 B1 | | 7/2001 | Kenney | |
| 6,283,493 B1 | | 9/2001 | Arduin et al. | |
| 6,290,249 B1 | | 9/2001 | Wolf | |
| 6,315,317 B1 | | 11/2001 | Liard et al. | |
| 6,325,404 B1 | | 12/2001 | Liard et al. | |
| 6,357,782 B1 | | 3/2002 | Pieber et al. | |
| 6,367,173 B2 | | 4/2002 | Lancon | |
| 6,394,482 B1 | * | 5/2002 | Carlson | 280/601 |
| 6,499,759 B2 | * | 12/2002 | DeBorde et al. | 280/609 |

OTHER PUBLICATIONS

Pages from ELAN X–Tech Series 1998–1999 Ski Brochure including Stealth and Phantom ski description.

* cited by examiner

*Primary Examiner*—Christopher P. Ellis
*Assistant Examiner*—Brian Swenson
(74) *Attorney, Agent, or Firm*—Fish & Richardson P.C.

(57) ABSTRACT

A snow glider is provided having a design that facilitates gliding through snow rather than skidding. The snow glider has an extremely narrow waist width combined with an elevated binding assembly to promote positive engagement with a skiing surface during use. The glider body waist is between 25–44 mm at its narrowest point. A further embodiment of the snow glider ski has secondary edges for effecting multiple, changeable turning radii in a single ski.

26 Claims, 8 Drawing Sheets

GLIDING SKIS

FIELD AND BACKGROUND OF THE INVENTION

The present invention relates generally to the field of ski construction and in particular to a new and useful ski apparatus capable of freely gliding on snow as opposed to skidding or scraping across the snow. The new ski has a uniquely narrow waist width, and a single- or double-bladed wing can be mounted above the primary ski for providing a secondary turning radius. The ski of the invention is substantially symmetrical with the narrow waist positioned midway along the length, and the tip and tail having similar shape and flexural characteristics. Additionally, the ski may include a bi-level suspension system with a boot binding assembly above the level of the running surface, and a quick release system for detaching the ski body from the suspension system and boot binding.

Recreational skiing as it is taught and practiced around the world is a skidding sport, as differentiated from gliding sports such as ice skating or in-line skating. Furthermore, the incline angle of a ski slope creates a downhill force that is typically up to five times greater than that necessary to propel the skier at the desired speed. Thus the basic essence of the sport of recreational skiing is speed control or constant braking.

In order to maintain speed and directional control, a conventional ski relies on the lateral friction generated between a ski slope surface and the ski edges as the ski skids, or slides, sideways relative to its longitudinal axis. The skier must therefore always have the skis oriented at an oblique angle relative to the downhill direction of movement. This requires the skier to be constantly alternating this angle from left to right of straight downhill in order to stay centered on the ski trail. This is a difficult and tiring movement.

In addition, graceful or controlled skidding requires a delicate balance in order to maintain the correct braking and directional forces with the snow. When too much lateral friction is generated, the skis and skier stop, and when there is too little friction, the skier effectively loses control of his direction and speed. Thus, the phrase, "catching an edge" used by a skier to justify falling down is accurate, since that is what occurs when the ski suddenly ceases to skid.

Early skis had substantially straight, parallel edges, and required greater skill from a skier. Modern skis are designed to have a long and wide shovel, or front portion, that helps start the skid, and a short and narrow tail that can easily complete the skid. And, the newest skis have increased width all along the ski length to provide a wider and more stable platform for skiers. In order to facilitate skidding or braking, the binding for holding a skier's boot to the ski is conventionally mounted toward the rear, or tail, of the ski.

In contrast, gliding sports, such as snow gliding, ice skating or in-line roller skating are designed to eliminate lateral friction or skidding with the supporting ground surface, allowing the person to maintain their momentum in the direction of travel with very little effort. Steering or controlling direction is accomplished by simply leaning or tipping in one direction or the other. The forces at work in gliding sports do not normally result in skidding nor require as much physical strain by the participant as skidding sports, such as snow skiing.

Gliding, in particular, is designed for recreational skiers who are not interested in the challenge or danger of conventional downhill skiing which requires control of speed on steep hills by regularly turning in skid turns on hard snow or plowing against soft snow.

Compared to gliding, a downhill skier must work harder because he is almost always moving (skidding) in a direction other than that to which the skis are pointed, requiring repetitious shifts in weight and body position between left and right stances in order to maintain the general downhill direction. Glide skiing involves gliding only in the direction to which the glider skis are pointed, and can provide a relaxing thrill gliding down an appropriately inclined hill rather than the stressful or feared descent that is typical of conventional skiing.

Unlike conventional skiing, glide skiing does not require constant braking and frictional speed control. Changes in direction do not require poles or skidding. Only gliding is necessary. Whereas conventional skis are designed to skid and not "catch an edge", gliding skis mandates an opposite approach that prevents skidding and encourages aggressive edge engagement. Accordingly, a ski construction and design is needed for facilitating gliding on snow, which is different from ski construction found in the prior art.

Modern skid-type ski construction is generally taught in many patents. U.S. Pat. No. 5,405,161, for example, discloses a ski having a waist portion which can be as narrow as 40–50 millimeters (2 inches or less), but preferably 55–70 millimeters wide, and ends which are between about 70–115 millimeters wide. The ratio of the width of the waist portion to the shovel is between 1:1.55 and 1:2.25. The shovel must be at least 1.05–1.43 times the width of the tail. Thus, the shovel and tail of the ski are not symmetrical. The boot bindings are not centered on the ski and are positioned closer to the tail than the shovel of the ski.

U.S. Pat. No. 5,727,807 teaches a ski having a waist portion comprised of two different sections to provide better edge control. A center portion of the ski bottom surface is covered with serrations. Unserrated edge portions of unknown width extend around the entire center portion; the total width of the ski is not disclosed.

U.S. Pat. No. 382,254 discloses a snow skate type ski having upswept tips and backs. The body of the ski has parallel sides, however, so that the ski does not taper inwardly at the waist where the boot is secured. The ski is described as being about 4 inches wide.

Other patents teach particular mountings for the boot bindings.

U.S. Pat. No. 5,984,344 discloses an elongated carrier for a binding connected to the ski in about the middle of the carrier. A pivoting connection of the carrier to the ski is disclosed, with damping bellows connected to each end of the carrier. The bellows and other damping mechanisms disclosed can be adjusted hydraulically to provide control over the stiffness of the ski in the binding region. The carrier is provided to permit adjustment of the bending properties of the ski and improve the control. The patent indicates that when the ski boot is elevated above the ski body surface, a high degree of edging is possible, giving greater control and stability.

U.S. Pat. No. 5,647,353 teaches a ski having a floating binding plate damped by a fluid pressure medium for modulating forces exerted on the ski. The pressure can be adjusted on the fly, if desired, to control the effect of the force modulation provided by the floating binding plate.

U.S. Pat. No. 5,671,939 illustrates a ski having the bindings mounted to permit continuous flexion of the ski body, even under the binding, so that the ski can form a continuous curve. The bindings are mounted to a plate movably secured to the ski. The relative spacing of the bindings is maintained when the ski is flexed by the pins connecting the plate to the ski moving forward and back within mounting slots secured to the ski body. The plate is secured at both ends, so that pivoting movement relative to the ski is not possible.

A binding support in the form of an elevated plate is disclosed by U.S. Pat. No. 5,915,719. In one embodiment, the support is connected at its center on a pair of feet secured to the ski. The ends of the support may have compressible shims inserted between the support and ski.

Still other patents disclose devices for improving the control over turning of a ski or snowbard.

U.S. Pat. No. 5,462,304 discloses a snowboard having interchangeable, dual-acting edges which extend continuously along the outside length of the active board edge. The interchangeable edges are provided to make repair and maintenance easier, as well as providing a simple method for adapting the snowboard to the skiing surface conditions. The interchangeable dual-acting edges each have a pair of control edges, one elevated above the other. The lower, first edge is oriented facing inwardly toward the board center, while the upper, second edge faces outwardly. The first edge contacts the skiing surface during level, flat riding, while the board be rolled onto the second, elevated edge in a sharp turn. The second edges act similar to a governor and provide stability in sharp turns so that the snowboarder can return to the first, lower edges without falling. The orientation of the edges is arranged to prevent the second edges from creating instability when the board is flat.

U.S. Pat. Nos. 5,040,818 and 5,462,304 each describe a ski for a vehicle such as a snow-mobile which has an elongated cylindrical wear bar mounted to the bottom middle of a center concave portion and a pair of horizontally extending concave surfaces vertically offset above the center concave portion. The horizontally extending concave surfaces are provided as primary steering surfaces and extend along the length of the ski on each side. The wear bar is provided to the first concave surface for when the ski is running on icy surfaces. The snow-mobile skis described do not have any secondary turning edges or surfaces.

U.S. Pat. No. 6,394,482 teaches a ski having an asymmetrical shape for improving the turning characteristics of the ski, but which lacks second turning edges. The ski shovels are shaped to have a slightly concave inner edge and an outer edge which curves outwardly to a point and then back in again toward the ski waist. The position of the point on the outer edge makes the curvature of the outer edge more closely match the curvature of the inner edge of the second ski during a turn, so that greater control and smoother turns are achieved.

As noted above, conventional skiers are always subject to a delicate balance of forces when their skis skid; a fall is likely when that balance is upset by changing friction conditions. The balance of forces is easily upset by minor changes in snow consistency which can cause a skidding ski to suddenly grab or engage the snow, or conversely, lose all friction when ice is encountered.

In contrast, snow gliding does not involve a frictional/skidding relationship with the snow. Instead, a glider ski has positive engagement with the snow or ice surface at all times. Changes in surface consistency are virtually irrelevant to a glider ski because it is not subject to a delicate balance and does not depend on lateral skidding. A glider ski user will generally not lose their balance due to changing surface conditions.

In glide-skiing, a skier is essentially always riding on an edge, similar to an ice skater, but without the need to constantly shift weight and stance to cause the edge to dig into contact with the snow. Gliding skis require certain design elements to optimize maneuverability, control, and engagement with the snow. These design elements are generally opposite and non-intuitive from the requirements for conventional skis. One design element of particular importance is the width between the edges at the waist. The waist portion is traditionally the narrowest point across the ski width and is often where the boot binding is mounted.

In conventional ski design, there has been a growing trend for a wider waist design in commercially available recreational skis. Today, most such skis have a waist width of about 70 mm. This wider waist creates a sense of stability when the ski is flat on the snow. Such a wide design, however, is counterproductive to ski edge engagement. That is, it is more difficult for a skier to roll onto the edges for making carved turns; but, this can be a benefit to maintaining a controlled skid and for skiers who frequently "catch an edge" and fall.

A glide skier contrarily wants to achieve the opposite result—the glider ski wants to catch the edge in positive contact with the surface, and then continually ride the edge without skidding. Therefore, a waist design is needed for glide-skiing so that the glider ski engages the snow similar to an ice skate blade.

Furthermore, the technique of conventional skiing involves step by step sequences of ski movements. The design of conventional skis parallels the sequences of movements by being asymmetrical. The front of the ski is optimized for turn initiation, while the tail and rear-biased boot position are designed for an easy skid at completion. In keeping with these design criteria, the width dimensions and flex characteristics of conventional skis vary between the front and rear of the ski. Unlike this sequential step method, glide-skiing is a continuous, fluid motion, and thus the glide skier has a symmetrical and balanced shape and construction.

The rigid mounting of ski boots on conventional skis precludes the middle section of the ski where the boots are mounted from flexing. The combination of the boot and binding restricts ski flexing to the front and tail sections only, keeping the middle section relatively straight and flat. This rigidity can help the skier shift weight for entering a skid turn.

A glider ski, on the other hand, must have substantially continuous flexural capability along the length of the ski to achieve positive engagement with the snow. Ideally, the glider ski shape conforms substantially to an arc when making turns. Therefore, a ski construction is needed to ameliorate the negative influence of the boot/binding on the flexibility of the glider.

The turning radius of both skis and gliders is determined by the shape of the running surface. Typically, the front and rear of the ski are wider than the middle of the ski under the boot. For a given pair of skis, the manufactured dimensions predetermine the turning radius. A skier must choose a specific pre-manufactured turning radius, and must remain locked into that turning style. This is extremely restrictive for both skiers and glide skiers, particularly when using glider skis that positively engage in the snow. Different conditions may make different turning radii desirable. There is a need to provide more versatility in turning radius.

SUMMARY OF THE INVENTION

It is an object of the present invention to provide a glider ski design optimized for positive engagement with a ground surface to provide maneuverability and control.

It is a further object of the present invention to provide a glider ski with a balanced and symmetrical shape.

Another object of the present invention is to provide a glider ski with consistent flexibility for conforming to turns.

A further object of the present invention is to provide a glider ski with increased responsiveness and steering control.

And a still further object of the present invention is to provide a glider ski having a variable turning radius.

Accordingly, a glider ski is provided having a narrow waist that is about one-half to one-third the width of conventional skis, a symmetrical geometry and flexural pattern, an adjustable bi-level suspension with a lower level glider body and an upper level boot binding assembly, a quick release mechanism for disengaging the lower level body from upper level boot binding assembly, and bladed wings mounted on the body at a dihedral angle with respect to the bottom surface of the primary runner.

A first embodiment of the glider ski has a symmetric body with equal width tip and tail and a significantly narrowed waist width. The boot binding is provided in about the center of the length of the glider ski. The waist width is between 25–44 millimeters, and the tip and tail have widths that are about twice the narrowest waist width of the glider.

Another version of the glider ski includes a boot binding elevated above the top surface of the ski and supported for flexion with the ski during a turn. The binding includes a rigid plate supported over the ski on a center fulcrum and flexible end supports. As the glider ski flexes during a turn, the flexible end supports compress as needed so that the portion of the glider under the rigid support plate can also flex. The glider ski thus has a continuous turning arc and provides a smoother turn than known skis.

In a further version of the glider ski, a second set of edges are provided adjacent the tip and tail of the ski. The second edges are elevated above the top surface of the ski and supported to extend outwardly of the primary ski edge. The second edges can be provided on wings at each of the tip and tail; the wings may be unitary at each end and extend over both side edges of the primary ski edge, or two separate pieces. The wings can be adjustably supported for changing their orientation relative to the primary ski, and most preferably, are tilted toward the primary ski to form an acute angle therebetween. The second edges on the wings provide a secondary turning edge for decreasing the turning radius of the skis when a glider ski turns more sharply. The wing second edges permit greater flexion of the glider ski through its length, and act in conjunction with the primary edge in the region of the boot binding.

In a still further version of the glider ski of the invention, a secondary ski is flexibly mounted over the top of the lower, primary ski. The primary ski is the same generally symmetric ski with a very narrow waist region as described above. The secondary ski is shaped similarly, but with a more extreme sidecut, and made slightly wider overall so that the secondary edges will extend past the primary ski edges. The secondary ski is fixedly mounted to the center waist of the primary ski and flexibly mounted adjacent the tip and tail of the skis. The flexibility of the secondary ski relative to the primary ski may be adjustable. The boot binding is mounted onto the secondary ski.

The secondary ski provides a complete second edge to the glider ski, connected so that the glider ski has two distinct turning radii. The turning radius of the primary ski is larger than the secondary ski, partly due to the more extreme sidecut of the secondary ski. As a glide skier leans over and switches from riding on the first edge to the second edge, the more extreme sidecut causes the ski to bend into a more radical arc, and thus a tighter turn can be made.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
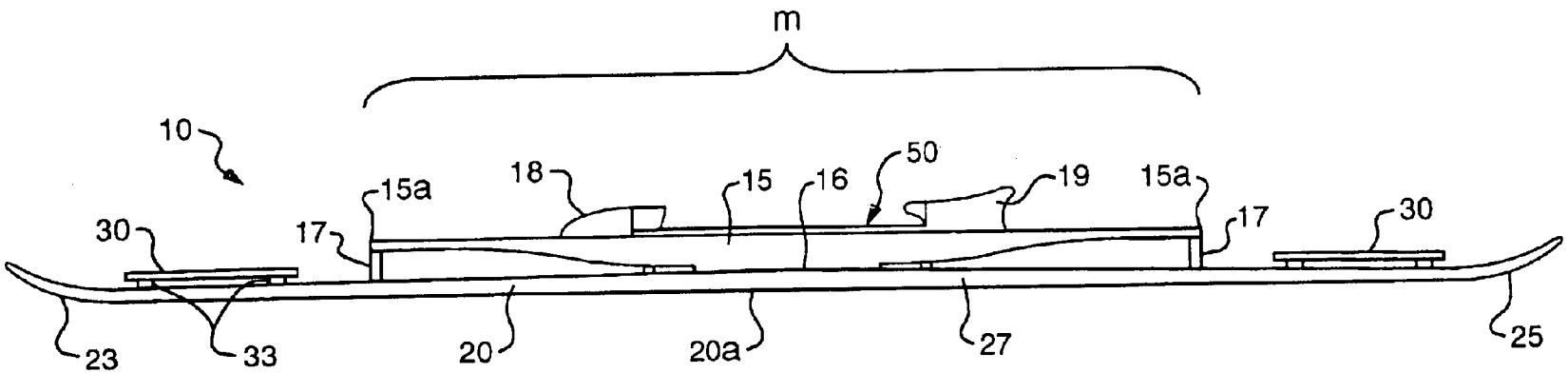
FIG. 1 is a side view of a glider ski according to the invention.

Referring now to the drawings, in which like reference numerals are used to refer to the same or similar elements, FIG. 1 shows a glider ski 10 of the invention. The glider ski 10 is one of a matched pair used for the relatively new skiing sport of glide-skiing, and the description herein should be interpreted to apply to the second ski in such a pair, except as noted. Typically, one glider ski 10 is equipped on each of a skier's feet using ski boots and bindings.

The glider ski 10 of the invention has increased turning ability and maneuverability as a result of improved flexibility achieved through the shape of the glider body 20 and additional components of the ski 10. The glider ski 10 has a bi-level design with a primary runner or glider body 20 defining a lower running surface 20*a* for contacting a skiing surface and a binding platform 15 for mounting a boot 40 above the glider body 20. Wings 30 are mounted above the level of the glider body 20 to provide a secondary contact edge for use during glide-skiing. The binding platform 15 and wings 30 and their benefits are described in greater detail below.

Glider Shape and Dimensions

Figure 2:
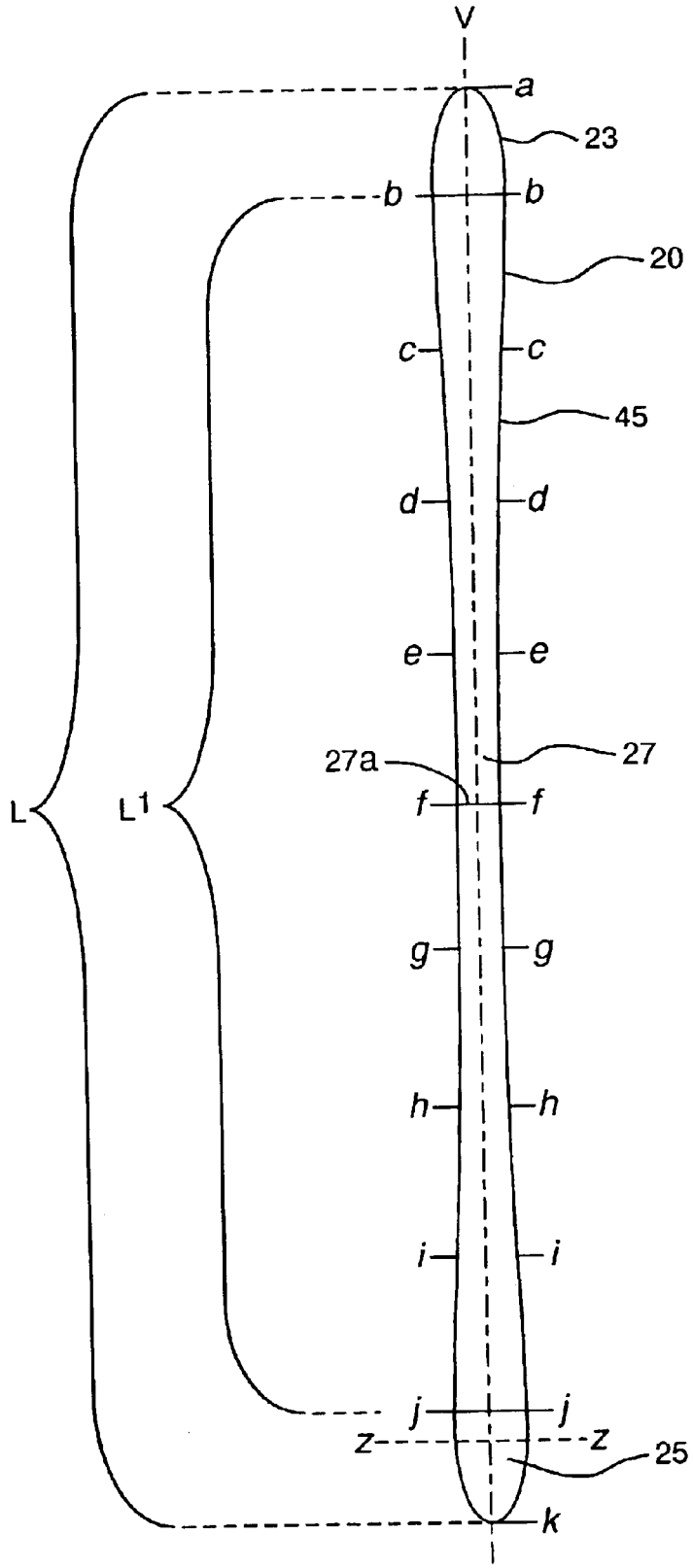
FIG. 2 is a top plan view of the glider body of FIG. 1.

Referring now to FIG. 2, the preferred shape of the glider body 20 is illustrated and will first be described. Reference letters a–k are used to designate sections along the length of the glider body 20 from the tip 23 to the tail 25.

The glider body 20 comprises a tip 23 at the front end a, a tail 25 at the rear end k. A sidecut portion 27 having a narrowest portion, or waist 27*a*, is located substantially equidistant between the tip 23 and the tail 25, stretching from at least points d–h, but the sidecut 27 can range between points c–i or even b–j. The glider body 20 generally tapers smoothly all along the sidecut 27 from the wider tip 23 and tail 25 to the waist 27*a*, near point f. The waist 27*a* is preferably located at a center point f between the tip 23 and tail 25. The taper of the sidecut 27 defines a concave shape on each side of the glider body 20 between the tip 23 and tail 25.

The sidecut depth of the glider body 20 is the difference, usually measured in millimeters, between a tangent of the tip 23 and tail 25 at their widest points and a parallel tangent of the waist 27*a* (the narrowest point of the sidecut 27). As will be appreciated, the taper forming the sidecut 27 is arcuate, and therefore has a turning radius defined as the radius of the circle to which the glider ski conforms when it is bent into an arc at the maximum lean angle during a turn. The sidecut 27 in turn defines and helps measure the turning radius of a ski, or how sharply the ski can turn, because difference in width between the wide ski ends 23, 25, and the narrow waist 27*a* will determine how much the ski will bend when leaned over on edge. Thus, a glider ski 10 with a small sidecut depth will have a large turning radius and not be able to turn as sharply as a glider ski with a larger sidecut depth and, thereby, a smaller turning radius.

Beginning at the front end a, and following the contour of the outer edge 45 of the glider body 20, the outer edge 45 is convex as it approaches a widest transition point b. In the embodiment shown, point b is where the tip 23 ends and the sidecut 27 and the taper begins. The sidecut 27 may begin farther down the length of the ski body 20, however, such as at point c or even point d. In such case, point c or d would be the transition point where the contour 45 begins to taper inwardly.

The outer edge 45 of the glider body 20 continues to taper through points c, d, and e, until it reaches the center or waist 27*a* of the sidecut 27. The waist 27*a* is preferably located at point f. The waist 27*a* is necessarily the narrowest portion of the glider body 20 along running length L'. In a preferred embodiment, point f is equidistant between points a and k, when tail 25 is turned upwardly, and between points b and j when tail 25 is flat. An important feature of the glider body 20 is that the waist center 27*a* has a width of between about 25 mm and 44 mm, and preferably between about 30 mm and 40 mm.

After point f, the taper of the sidecut 27 reverses and the ski body 20 gradually widens from points f to j, where the sidecut 27 preferably ends and the tail 25 begins. As with the front of the ski body 20 above, the sidecut 27 may extend to the rear only as far as point i, or less preferably, only to point h.

The glider body 20 is preferably symmetrical between the ends about waist 27*a*, and also about the longitudinal axis V. That is, the glider body 20 preferably has mirror-image sidecuts 27 through its length, and the tip 23 and tail 25 are preferably identically sized as well. However, the left and right sidecut 27 contours may differ from one another without deviating from the invention, as described herein.

Accordingly, the width proportions of the tip 23 to the waist 27*a* to the tail 25 are preferably in the ratio 2:x:2, where x is a number greater than or equal to about 0.5 and less than or equal to about 1.5. The glider ski 10 of the invention conforms to the ratio and has a waist width of 25–44 mm and tip 23 and tail 25 widths that are each 20–70 mm greater than the waist width. While it is not preferred, the widths of the tip 23 and tail 25 may differ, so that the ratio of the widths of the tip 23 and tail 25 may vary from about 1.25:1 to 1:1.

The glider body 20 has a total length L and a running length L'. The running length L' is the total length L of the glider body 20, excluding the tip 23 and the tail 25. The running length L' is generally the portion of the running surface 20*a* which can potentially be in contact with a skiing surface at any given time.

In an example of a preferred embodiment, the total length L for the glider body 20 is about 169 cm. If both the tip 23 and the tail 25 are curved upwardly, they are each preferably about 12.5 cm long. The running length L' is then preferably about 144 cm, or the total length L less the 12.5 cm tip and the 12.5 cm tail. However, in an alternative embodiment, the tail 25 may be horizontal. In such case, the tail is made about 4.5 cm long, extending between points z and j, and the running length L' would be the same, or about 144 cm. The running length L' is usually about the same as the linear distance between ends of the sidecut arc, such as when the sidecut 27 extends between points b and j.

In the preferred embodiment of the invention, the running length L', is divided into equal segments sized about 12.5% of the running length L'. In the example of a 169 cm long glider body 20, there are preferably eight, 18 cm long segments in the 144 cm running length L'. In FIG. 2, the segments are identified as the lengths between each pair of adjacent points b–j.

As noted above, points b and j are the widest portions of the glider body 20, bordering the tip 23 and tail 25. When the glider body 20 is symmetric, as in a preferred version, the width of the glider body at points b and j will be twice the sidecut depth plus the width dimension of the waist 27*a* located at point f. For example, if the sidecut 27 at point f has a waist 27*a* width of 38 mm, and the sidecut depth is 21 mm on each side, the width of the glider body 20 or ski at points b and j will be 80 mm. These dimensions are compatible with the most preferred width ratio of the tip 23 (point b), waist center 27*a* and tail 25 (point j) of 2:x≦1:2.

The taper of the sidecut 27 is smooth and continuous. The depth of the sidecut 27, and thereby the corresponding width of the glider body 20 at each segment break point b–j is preferably related to the distance of the respective point b–j from point b or j. The width of the glider body 20 at a given point is determined as a percentage of the combined sidecut depth of each side at the waist 27*a*, plus the width of the waist 27*a*. The segments are equal length, while the contours 45 of the glider body 20 are part of an arc. Thus, the percentages applied at each break point between segments will not change linearly, but rather, exponentially or logarithmically.

The following table illustrates the percentage relationships for a typical glider body 20 having a total length L of 169 cm, a waist 27*a* that is 38 mm wide, a sidecut 27 that is 21 mm per side, or 42 mm combined, and therefore, a tip 23 and tail 25 each 80 mm wide:

TABLE I

| Point on Glider Body | % distance from center f toward b, j | % sidecut depth (42 mm) | Width of Glider Body |
|---|---|---|---|
| b, j | 100% | 100% | 80 mm |
| c, i | 75% | 58% | 62 mm |
| d, h | 50% | 25% | 48.5 mm |
| e, g | 25% | 6% | 40.5 mm |
| f | 0% | 0% | 38 mm |

The following Table II illustrates the percentages for a second glider ski 10 with a tighter turning radius and narrower waist 27*a*. The glider ski 10 of the following example has a total length of 159 cm, a running length L' of 134 cm, a waist 27*a* width of 29 mm, tip 23 and tail 25 widths of 77 mm and a sidecut depth of 24 mm per side (48 mm total):

TABLE II

| Point on Glider Body | % distance from center f toward b, j | % sidecut depth 48 mm) | Width of Glider Body |
|---|---|---|---|
| b, j | 100% | 100% | 77 mm |
| c, i | 75% | 60% | 58 mm |
| d, h | 50% | 26% | 41.5 mm |
| e, g | 25% | 6% | 32 mm |
| f | 0% | 0% | 25 mm |

A further example of a glider ski 10 having a narrow waist 27*a* width, but a reduced turning radius is provided in Table III, below. The ski 10 of this example is 197 cm long, has a running length L' of 172 cm, a waist 27*a* width of 36 mm, tip 23 and 25 tail widths of 74 mm and a sidecut 27 depth of 19 mm per side (38 mm total):

TABLE III

| Point on Glider Body | % distance from center f toward b, j | % sidecut depth (38 mm) | Width of Glider Body |
|---|---|---|---|
| b, j | 100% | 100% | 74 mm |
| c, i | 75% | 58% | 58 mm |
| d, h | 50% | 25% | 45.5 mm |
| e, g | 25% | 6% | 38 mm |
| f | 0% | 0% | 36 mm |

Table IV, below, illustrates the dimensions of a glider ski 10 having a wider waist 27*a* width of 42 mm, tip 23 and tail 25 widths of 100 mm, a length of 189 cm, and a running length L' of 164 cm, and a sidecut 27 depth of 29 mm per side (58 mm total).

TABLE IV

| Point on Glider Body | % distance from center f toward b, j | % sidecut depth (58 mm) | Width of Glider Body (mm) |
|---|---|---|---|
| b, j | 100% | 100% | 100 mm |
| c, i | 75% | 60% | 77 mm |
| d, h | 50% | 26% | 57 mm |
| e, g | 25% | 7% | 46 mm |
| f | 0% | 0% | 42 mm |

The percentages of the total side cut added to the waist 27*a* width at each segment to determine the glider body 20 width may be adjusted to fine tune the sidecut contour for specific performance objectives. The values set forth in Tables I–IV are exemplary of some constructions only and are not intended to limit the invention.

As stated above, the tip 23 and the tail 25 are preferably the same width, but their widths may differ by up to 15 mm for special applications. The tip 23 and the tail 25 are each typically 20 mm to 70 mm wider than the waist 27*a*. The waist 27*a* width must be within the stated ranges, above.

Further, in accordance with the invention, the total length L of the glider body 20 can range between 100 cm. and 200 cm., and even more preferably between 140 and 190 cm.

The base or running surface 20*a* of the glider body 20 is preferably made of an appropriate plastic, carbon fiber or other conventional ski body material. The running surface 20*a* is preferably bordered on each edge by blade edges 22 made of steel or other hard metal or materials commonly used for conventional ski edges. Clearly, the dimensions and selected materials for the glider body 20 and blade edges 22 must permit flexion as intended for the glider body 20.

Binding Support System

Referring again to FIG. 1, the binding platform 15 has binding elements 18, 19 of a binding assembly 50 for securing a boot (not shown in FIG. 1) to the glider ski 10. The platform 15 is rigidly connected to the glider body 20 beneath the center of the binding elements 18, 19. The platform 15 is preferably centered over the waist center 27*a* of the glider body 20. That is, the mounting position for the boot bindings is centered about the waist center 27*a*.

Suspension and lateral support components 17 are provided between the glider body 20 and each of the toe and heel ends 15*a* of the binding platform 15. The lateral support portion of components 17 prevent lateral pivoting movement of the platform 15 relative to the glider body 20. The adjustable suspension part of the components 17 react to the bending of the glider body 20 during a turn and control the flexural characteristics and stiffness of the glider ski 10.

The components 17 may be compressible solid materials, such as rubber or polymers, or more complex structures with compression springs, or hydraulics, similar to shock absorbers. The components 17 are connected to the platform 15 and/or glider body 20 in any known manner which will permit the stated relative movement between the platform 15 and glider body 20.

The platform 15 is designed to rigidly support a boot above the glider body 20. At the same time, the platform 15 spaced above the glider body 20 permits the ski body 20 to flex a greater amount than would be possible by mounting binding elements 18, 19 and the boot directly to the glider body 20. The components 17 permit the glider body 20 to flex against the platform at each end 15*a* during a turn.

Figure 3:
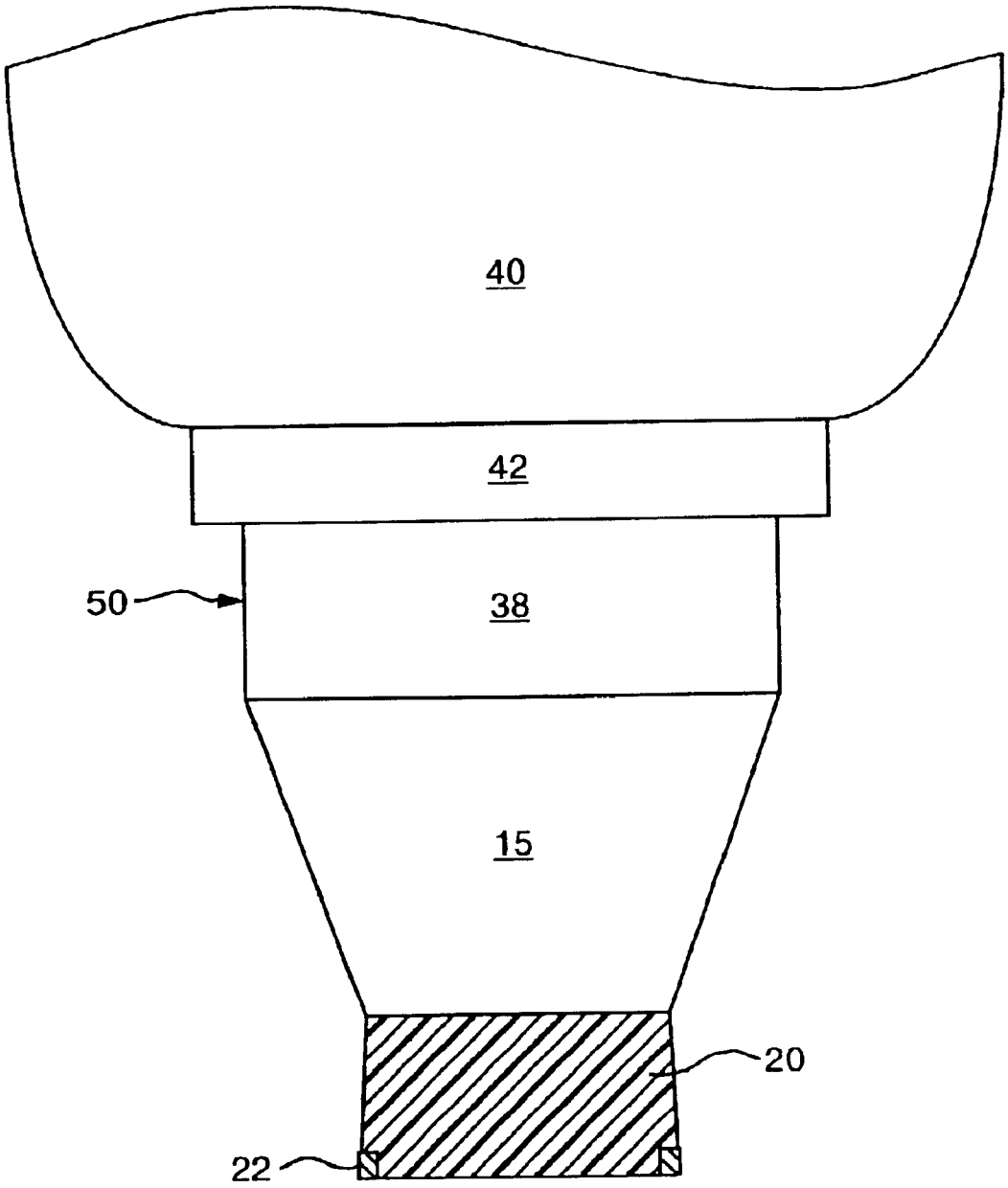
FIG. 3 is cross-sectional view of the binding region of the glider ski of FIG. 1 with a boot attached.

FIG. 3 displays a sectional view at point f of a boot 40 supported on binding base 38 of binding assembly 50 connected to the binding platform 15. The boot base 42 rests directly on the binding base 38 used to help secure the binding elements 18, 19 to the platform 15. As seen, the platform 15 is secured directly to glider body 20 at point f.

The primary running edges 22 of the glider body 20 are best seen in this view as well. The primary running edges or blade edges 22 extend at least along the running length L' of the glider body 20. Typically, edges 22 are made from a strong metal, such as steel, capable of cutting into ice with minimal deformation, or wear.

Turning again to the boot 40 support, the elevated binding platform 15 provides clearance for the boot above the top height of the skiing surface during extreme lean-over angles that may be encountered in a turn. The sole and body width of a typical ski boot 40 is significantly wider than the narrow waist width of the glider body 20, as described above.

Conventional skis have boots that are rigidly mounted to the main runner body, thereby precluding the center section of the ski from flexing, especially during a turn. The combination of the boot and binding limits conventional ski flexing to the tip and tail sections only, keeping the center waist section under the boot relatively straight and flat. The stiffness of the waist of conventional skis is problematic to glide-skiing which requires continuous engagement with the snow, and therefore, complete flexibility of the runner or glider body 20. The bi-level design of the present invention allows the running surface to assume a virtually continuous flexible curve unrestricted by the presence of a boot biding apparatus.

The top surface of the platform 15 ranges from 40–70 mm above the bottom surface of the glider body 20. The total length m (shown in FIG. 1) of the platform 15 ranges from 40 to 90 cm, and is proportionate to the total length L of the glider body 20.

In a further embodiment, the platform 15 can be permanently mounted or detachably mounted using a quick release mechanism. The platform 15 is preferably mounted at the approximate center of the glider body 20 above the waist 27*a*, and most preferably located around midpoint f. The mounting portion 16 of platform 15 directly contacts only about 15 cm of the length of the glider body 20. The remaining length of the platform 15 is cantilevered over the glider body 20. The mounting portion 16 may contact between 10–20 cm of the length of glider body 20.

In yet another embodiment, the binding platform 15 may be mounted so as to permit some forward and backward pivoting about the fixed connection relative to the glider body 20. Sliding, lateral, side-to-side pivoting, and rotational movement are not permitted, and are controlled in part by components 17.

Secondary Edges

In a further aspect of the glider ski 10 of the invention illustrated generally in FIG. 1, and several embodiments which are shown in FIGS. 4–12, a secondary running surface 32 on wings 30 connected positioned above the level of the primary running surface 20*a* of the glider body 20.

The turning radius of a conventional ski is determined by its inherent shape, most specifically the magnitude of the sidecut and the length of the ski. These features of a ski are not adjustable. Thus, the specific turning geometry of a ski is predetermined at the time of manufacture by the dimensions of the ski.

The glider ski 10 of the invention can include secondary running surfaces 32 on extensions or wings 30 attached above the glider body 20. The wings 30 are oriented so that the secondary running surface, or edges 32, upon engagement with the skiing surface, will cause the glider body 20 to bend into a deeper curve that can significantly exceed the radius limitations inherent in the primary shape of a conventional ski or the glider body 20. The secondary running surfaces 32 are raised above the level of the primary edge 22, so that they do not contact the skiing surface until the primary glider or ski 20 is leaned beyond a specific angle in a turn. When this angle is exceeded, the wider edges 32 of the wings 30 contact the skiing surface, and the narrow waist 27*a* must then bend inwardly a significantly greater amount in order to maintain contact with the skiing surface. This results in a tighter arc and a dramatic increase in turning radius.

The several embodiments for achieving this aspect of the invention will now be described with particular reference to the drawings.

Secondary runners in the form of wings 30 are shown in FIG. 1 in preferred positions adjacent the tip 23 and tail 25 of the glider body 20. The wings 30 are connected to the glider body 20 arranged above the upper surface of the glider body 20. The wings 30 are mounted a distance above the running surface 20*a*, so that they do not engage the snow surface until the glider is leaned over beyond a specific angle on the edges 22 of the glider body 20 while in a turn.

Figure 4:
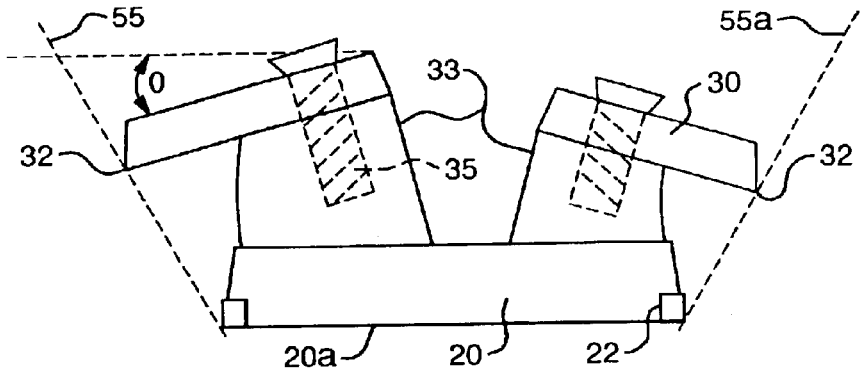
FIG. 4 is a front view of the glider ski and the bladed wings oriented at a dihedral angle of 15 degrees to the primary running surface of the glider ski.
Figure 4A:
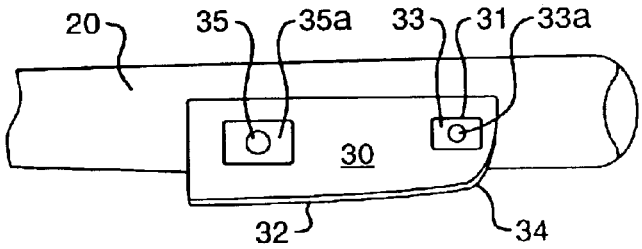
FIG. 4A is a top plan view of one bladed wing of FIG. 4 with an adjustable securing mechanism.
Figure 5:
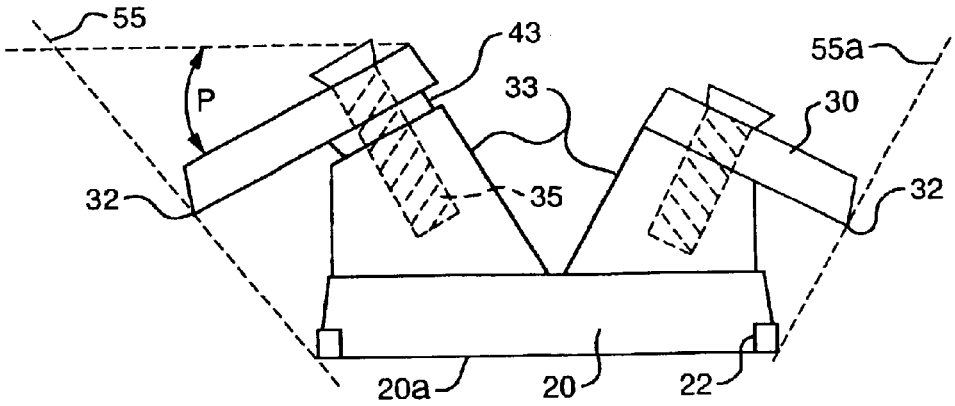
FIG. 5 is a front view of the glider ski and the bladed wings oriented at a dihedral angle of 30 degrees to the primary running surface of the glider ski.

As further illustrated by FIGS. 4, 4A and 5, the wings 30 may comprise a total of four wings 30 connected to the glider body 20. One wing 30 is arranged to extend past the primary running edge 22 of the glider body 20 on each side at the tip 23 and tail 25. The length of each wing 30 preferably ranges from 10% to 20% of the length L of the primary glider body 20 to which they are attached. The wings 30 may be as wide as the glider body 20 at the point where they are attached, or be only a fraction of the width of the glider body 20. Preferably, the leading edge 34 of each wing is rounded and/or turned upwardly like the tip 23 of the ski 10 to prevent it from digging in to the skiing surface and causing sudden stops.

Each wing 30 is constructed of a lightweight high strength material such as Kevlar, carbon fiber, or other high strength composite combined with a hardened steel edge. Alternatively, the wings 30 can be made wholly of titanium or other metal with a hardened edge.

The wings may be mounted to the glider body 20 by a number of methods. FIGS. 4 and 5 illustrate how wings 30 may be removably and adjustably mounted at different angles relative to horizontal using mounting bosses 33 and bolts 35. The mounting bosses 33 are affixed to the primary glider body 20 using permanent adhesives or other fasteners such as are known for securing objects to skis. Spacer elements 43 can be provided between the wing 30 and the mounting boss 33 to adjust the vertical spacing of the secondary edge 32 above the running surface 20*a* and primary edge 22. Preferably, the wings 30, and in some cases, the bosses 33 also, are mounted for easy removal from the glider body 20 for using the glider body 20 independently, or for changing wings 30 for different conditions or purposes.

Preferably, two mounting bosses 33 are provided for securing each wing 30 at the front end and back end, as seen in FIG. 1. Although only one mounting boss 33 is necessary, two mounting bosses 33 will help prevent unwanted pivoting of the wing 30 during use. Each mounting boss 33 may be formed of resilient compressible materials, so that the pitch of the wing front to back can be adjusted.

FIG. 4A illustrates a configuration which permits further adjustment of the lateral and longitudinal position of each wing 30. A mounting hole 31 through the wing which is smaller than the mounting boss 33 is provided. Mounting boss 33 has a bolt hole 33*a* for receiving a bolt 35. The mounting hole 31 is sufficiently large compared to the size of the bolt hole 33*a* that the wing 30 can be moved laterally or longitudinally, then fixing plate 35*a* is laid over the mounting hole 31, and bolt 35 is tightly fastened to compress the fixing plate 35*a* against the wing 30 around the mounting hole 31. The fixing plate 35*a* may be a rigid metal plate with a rubberized or similar high friction surface for contacting the wing to provide better holding.

Other adjustment mechanisms for securing the wings to the glider body 20 can be used as well. For example, the wings 30 may be attached using a hinge at one end of the wing and a compressible elastomer support at the other end for allowing pitch adjustment of the wing 30. An eccentric cam mounted under the wing 30 could also be used as an adjustment mechanism, as a further example.

The particular selected height of secondary edges 32 above the running surface 20*a* and location of the wings 30 relative to the sidecut 27 directly affect the possible additional flexion of the glider body 20. This in turn directly affects the turning radius while the secondary edges 32 of the wings 30 are engaged with the snow or other skiing surface. The relative heights of the blade edges 32 and 22 can be adjusted to control the engagement angle of the secondary edges 32; that is, the roll angle at which the increased turning radius becomes available to the skier.

The wings can also be adjusted longitudinally. By longitudinally moving the blades 30 and 22 toward the center of the glider body 20, and shortening their effective length, the glider body 20 will turn along a smaller and tighter radius.

The extent to which a wing blade 22 may extend away from the glider body 20 is another important factor affecting the size and activation of the secondary turning radius.

Wings 30 that are displaceable further outward of the glider body 20 will have their running edges 32 contact the skiing surface much sooner than those of wings 30 that are positioned nearer to the glider body 20. Referring to FIGS. 4 and 5, lines 55, 55*a* illustrate how a wider wing will contact the skiing surface sooner during a turn. Thus, the farther outward the wings 30 are positioned, the less edge roll or lean during a turn is needed to engage the secondary blade edges 32 against the snow to create the shorter turning radius effect provided by the wings 30. Most dramatically, moving the wings 30 outwardly increases the effective sidecut 27 provided by the secondary edges 32, thus creating a much tighter turning radius that is not available using only the primary ski.

Alternately, wings 30 of different widths can be provided instead. Similarly to adjusting the outward extension, wider wings will provide an increased effective sidecut 27 of the glider body 20 that will create a tighter turning radius compared to narrower wings. The wing 30 width sets the secondary turning radius, and is preferably selected so that the secondary blade edge 32 extends at least 10 mm past the primary blade edge 22 of the glider body 20 when the wing 30 is attached. Most preferably, the wing 30 is sized so that secondary edge 32 extends between 10–25 mm past the primary blade edge 22.

Using the attachment systems described above, the wings 30 can be easily connected and removed, thereby allowing a variety of wings 30 of different widths to be interchangeably used with the glider body 20.

The mounting angle of the wings 30 can be adjusted from parallel to the skiing surface to various downward dihedral angles relative to the skiing surface. When the wings 30 are oriented at dihedral angles the positive engagement of the secondary edges 32 is greatly enhanced, especially on ice and hard packed snow. The positive engagement of the edges 32 is further enhanced by beveling the side edge of each wing to provide a sharper blade angle for penetrating snow and ice. As discussed, above, positive engagement with the skiing surface is necessary to properly enjoy glide-skiing, compared to skiing. The dramatically improved edge grip created by the dihedral angle of the wings 30 and edges 32 can also provide significant advantages in ski racing applications such as giant slalom and super G.

FIGS. 4 and 5 show wings 30 adjusted to provide different downward dihedral angles with respect to the skiing surface in a rest position, and, as well, the primary running surface 20*a*. FIG. 4 shows a partial sectional view of glider body 20 with wings 30 adjusted to provide a dihedral angle o that is 15 degrees below horizontal.

In FIG. 5, a glider body 20 has a wing 30 mounted a greater distance above glider body 20, but with a greater pitch to the top surface of the mounting boss 33, thereby creating a greater dihedral angle p, which is 30 degrees below horizontal. While two embodiments are illustrated, the dihedral angle may range between 10° and 75°, with angles between 10° to 60° being preferred, and dihedral angles of 10° to 45° being most preferred. The angle of the wings 30 may be zero as well, when no dihedral angle is made between the wings 30 and running surface 20*a*.

While FIG. 1 displays the wings 30 located at each of the tip 23 and tail 25 of the glider ski 10, wings 30 can be used at the tip or tail only, or only along the outer edges of each left and right glider ski 10 in a pair. Further, a single wing 30 can be used on the outer edge of either the tip 23 or the tail 25 of each glider.

Figure 6:
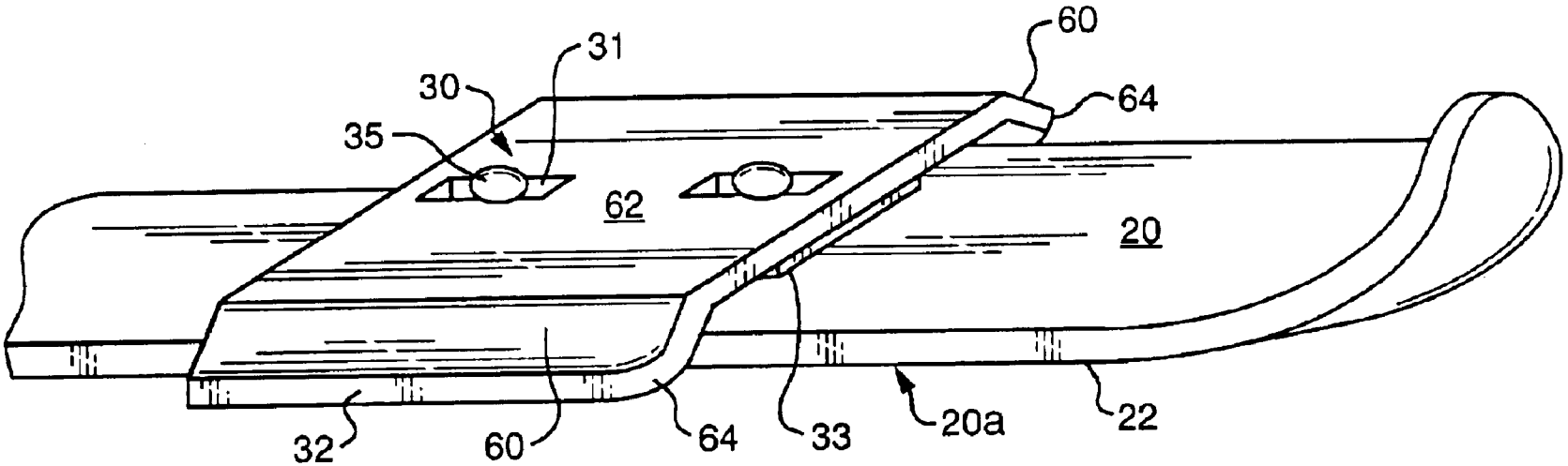
FIG. 6 is a partial front, top, right perspective view of a glider ski with a second embodiment of the wing.
Figure 7:
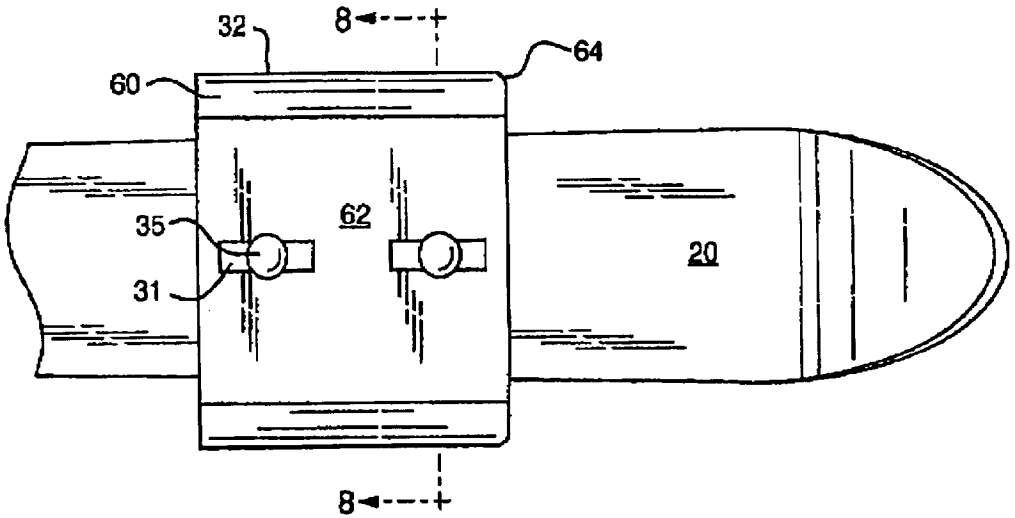
FIG. 7 is a top plan view of the glider ski and wing of FIG. 6.
Figure 8:
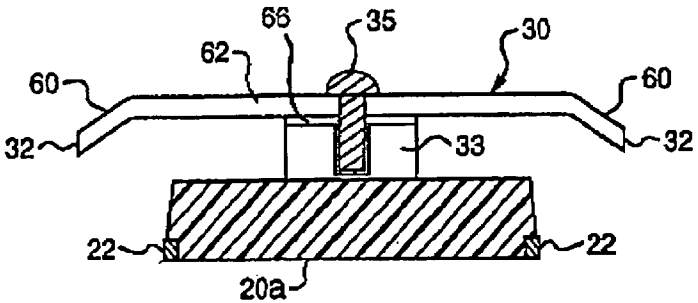
FIG. 8 is a front sectional view of the ski of FIG. 7 taken along line 8—8.

FIGS. 6–8 display an alternate embodiment of the wings 30 in which a unitary wing 30 having center support section 62 and vanes 60 carrying secondary edges 32 extends across the snow glider body 20.

The vanes 60 may be angled downwardly to form a dihedral angle with the skiing surface, and the primary running surface 20*a* in a rest position. The vanes 60 are sufficiently wide as to extend a secondary running edge 32 to each side of the glider body 20. Similar to the separate wings, the leading edges 64 of each vane 60 are preferably rounded and turned upwardly to avoid the vanes preventing forward motion or causing a sudden stop.

The center support section 62 is used to mount the wing 30 to the glider body 20. Bolts 35 are used to removably and adjustably fasten the support section 62 to a pair of mounting bosses 33 through mounting holes 31. As shown, mounting holes 31 may be slots for adjusting the longitudinal position of the wing 30.

In FIG. 8, a spacer 66 is positioned between center support section 62 and mounting boss 33. Bolt 35 is inserted through the spacer 66 and secured to the mounting boss 33 and the center support section 62 to position the wing 30 elevated above the glider body 20. When two mounting bosses 33 are provided, different height spacers 66 can be provided around the bolt 35 to adjust the pitch of the wing forward and back. The connection must be sufficiently rigid to prevent lateral displacement or pivoting movement of the wing 30 during use of the glider ski 10. Additional bosses 33 or bolts 35 can be provided to further increase the rigidity of the connection between the wing 30 and glider body 20.

Figure 9:
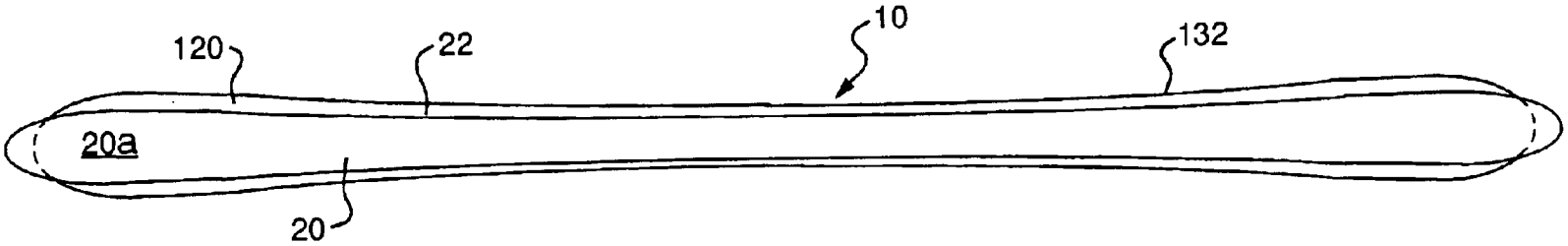
FIG. 9 is a bottom plan view of a second embodiment of the glider ski of FIG. 1.
Figure 10:
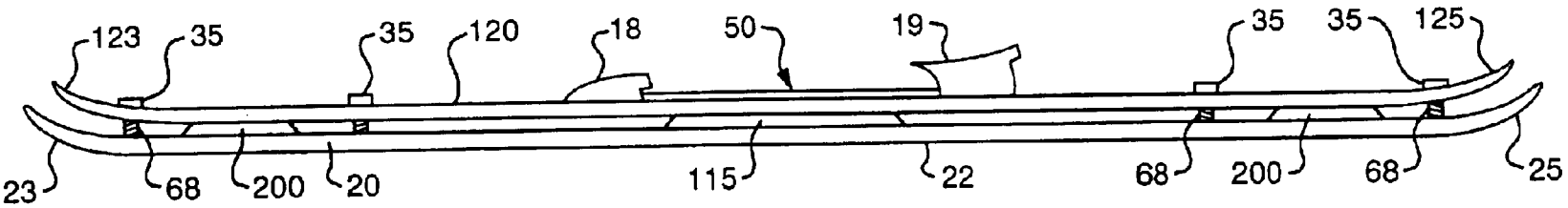
FIG. 10 is a side elevation view of the embodiment of the ski of FIG. 9.

FIGS. 9 and 10 show yet another embodiment of the glider ski 10 having a secondary edge 32. A complete secondary ski 120 is mounted over the primary glider body 20, so that a continuous secondary edge 32 is provided over the primary edge 22. The secondary ski 120 is mounted using a center mounting block 115, bias springs 68 and retaining bolts 35, and spacer blocks 200. The secondary ski 120 is preferably detachable from the primary glider body 20.

The secondary ski 120 carries binding assembly 50 with toe and heel binding elements 18, 19. The secondary ski 120 can be a conventional style ski mounted above the glider body 20, or it may be simply a wider glider body, such as when the primary glider body 20 is about 25 mm wide at the waist center 27*a*. The secondary ski 120 is provided so that the secondary edges 32 extend outwardly from the sides of the glider body 20 for engagement with the skiing surface during a turn and providing a secondary turning radius.

The bolts 35 are firmly mounted to the lower primary glider body 20 and pass through slots in the upper, secondary ski 120. The retaining heads of bolts 35 keep the secondary ski 120 in axial alignment and at a fixed distance from the primary glider body 20, while allowing relative fore and aft movement between them. The bias springs 68 connecting the secondary ski 120 and glider body 20 restrain the fore and aft movement and may be adjustable or exchangeable to change the amount of flexion available in the glider ski 10. Under high spring compression, the combined runners 20, 120 and mounting block 115 and spacer blocks 200 will act similar to a rigid truss or an I-beam and be extremely stiff. Conversely, reduced spring compression permits limited relative longitudinal movement between the glider body 20 and secondary ski 120, allowing the glider ski 10 to bend more freely during turns.

The spacer blocks 200 are constructed of a firm, low-friction material, such as DELRIN or TEFLON polymers, which will support the secondary ski 120 and the applied forces, but will also allow the limited sliding between the two runners 20, 120 necessary for flexing into an arc for turning. Spacer blocks 200 are provided along the length of runners 20, 120, and firmly attached to glider body 20 for maintaining vertical spacing between the runners 20, 120.

The mounting block 115 connects the secondary ski 120 and glider body 20 firmly together. Such connection may be permanent or it may be detachable instead. The bodies of each of the primary and secondary skis 20, 120 in this embodiment in particular can be uniquely constructed of extremely lightweight, thin sections of carbon fiber or other similar composite material due to the fact that the bi-level truss construction provides structural rigidity that a single ski would not have.

Figure 11:
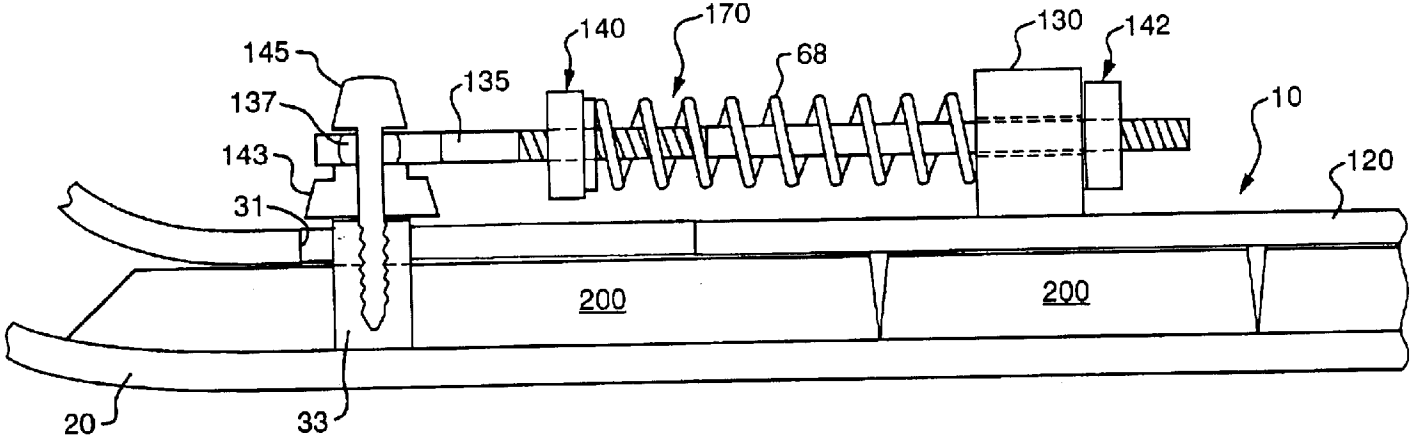
FIG. 11 is a magnified side elevation view of an alternate flexibility adjustment mechanism for the glider ski of FIG. 9.
Figure 12:
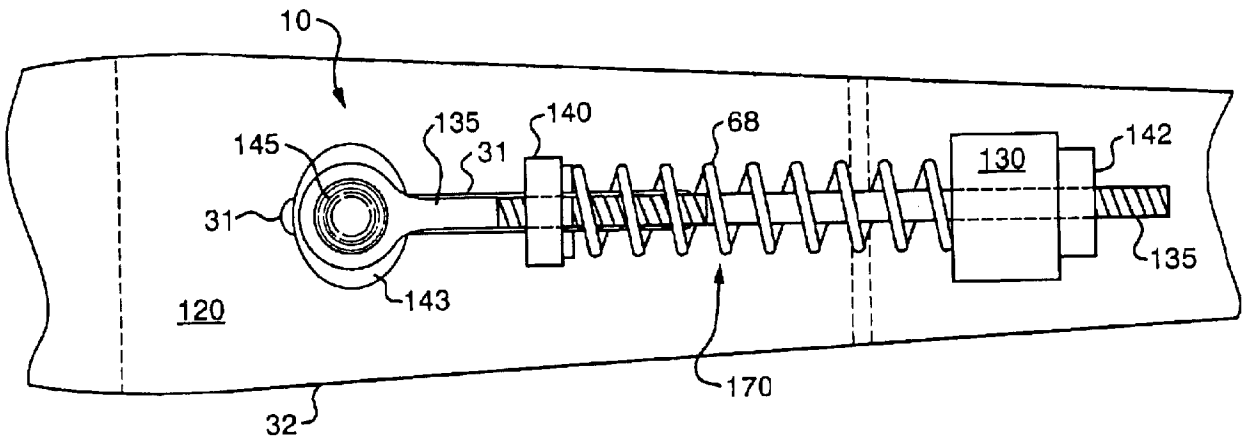
FIG. 12 is a top plan view of the adjustment mechanism of FIG. 11.

FIGS. 11 and 12 illustrate an alternate tensioning mechanism for use with the glider ski 10 embodiment of FIGS. 9 and 10.

A mounting boss 33 is located between secondary ski 120 and connected to glider body 20. A mounting slot 31 is formed through secondary ski 120 above the position of the mounting boss 33 for permitting longitudinal movement of the secondary ski 120 relative to the glider body 20. A tensioning mechanism 170 on the secondary ski 120 secures the secondary ski 120 to the glider body 20 via the mounting boss 33 and mounting slot 31.

The tensioning mechanism 170 includes a bias spring 68 held on a tension bar 135 between a tension mount 130 secured to the secondary ski 120 and a first threaded nut 140. A second threaded nut 142 limits the maximum decompression movement of the rod 135 and spring 68, and thereby provides a unique method of adjusting the no-load, pre-camber arc of the glider ski 10. A connecting pin 145 is inserted through a bar loop 137 at the end of the tension bar 135 opposite the tension mount 130. A spacing washer 143 is provided between the bar loop 137 and secondary ski 120 surface that retains the secondary ski 120 to the primary glider body 20 and also aligns the tension bar 135 substantially horizontal with the secondary ski 120. The connecting pin is rigidly secured to the mounting boss 33 through the bar loop 137, spacing washer 143 and mounting slot 31.

The tension mechanism 170 is adjustable by changing the position of the two threaded nuts 140, 142 on the tension bar 135. By permitting the bias spring 68 to expand, by loosening nut 140, tension is released and the glider ski 10 can flex more easily, while compressing the bias spring 68 will reduce the flexibility of the ski 10. And, the secondary ski 120 is thus movable longitudinally for the length of the mounting slot 31 relative to the glider body 20. Loosening nut 142 allows the glider 10 to flex into a more extreme negative camber or concave arc under no-load occurences. In a preferred embodiment, tensioning mechanisms 170 are provided at each end of the glider ski 10 for easily and quickly adjusting the limits and amount of flexion available.

In the case of both the wings 30 and the secondary ski 120, it is noted above that the height of the secondary edges 32 above the skiing surface will affect the lean angle required to engage the secondary edges 32. Thus, it is envisioned that the wings 30 and secondary ski 120 may be mounted at any distance above the glider body 20, depending on other factors, including the outward extension of the secondary edges 32 from the adjacent primary edges 22 and dihedral angle of the wings 30 or vanes 60, if any. For most applications, however, it is envisioned that the wings 30 or secondary ski 120 will positioned to place the secondary edges 32 within the range of about 5 mm to 150 mm, and preferably within the range 10 mm to 70 mm, above the edges 22 of primary glider body 20.

It is also conceivable within the scope of the invention, that a second set of wings, wider than a first set of wings 30 or a secondary ski body 120, can be mounted above them to create a tertiary running edge, and an even more extreme turning radius.

While a specific embodiment of the invention has been shown and described in detail to illustrate the application of the principles of the invention, it will be understood that the invention may be embodied otherwise without departing from such principles.

What is claimed is:

1. A glider ski, comprising:

a glider body having a tip end, a tail end, a running surface and a primary edge on each side of the running surface between the tip end and tail end, each side of the glider body having a continuous taper toward a center of the glider body from each of the tip end and tail end, the continuous taper defining a sidecut having a waist, wherein a width ratio of a maximum width of each of the tip end and tail end to a waist width is between 2:0.5 and 2:1.5, and the waist width is less than 40 mm, and wherein no part of the glider body extends past a vertical plane extending upwardly from each primary edge; and (b) a binding platform secured to the glider body at a binding assembly mounting position over the waist, the binding platform being configured to hold binding assembly spaced above the glider body.

2. A glider ski according to claim 1, wherein the tip and tail have the same maximum width.

3. A glider ski according to claim 1, wherein the binding platform has a mounting portion connecting the binding platform to the glider body, the mounting portion contacting between 10–20 cm of the length of the glider body.

4. A glider ski according to claim 3, wherein a part of the mounting portion is connected to the glider body at the waist.

5. A glider ski according to claim 1, wherein the binding platform is raised between 4–7 cm above the height of the glider body.

6. A glider ski according to claim 1, further comprising at least one secondary edge connected to the glider body spaced vertically above and horizontally offset outwardly from one of the primary edges.

7. A glider ski according to claim 6, comprising a pair of secondary edges, one secondary edge spaced vertically above and horizontally outward of each primary edge.

8. A glider ski according to claim 7, wherein the pair of secondary edges are carried on a wing mounted to the glider body.

9. A glider ski according to claim 8, wherein the wing is adjustable longitudinally and pivotably relative to the glider body between the tip end and tail end.

10. A glider ski according to claim 6, comprising two pairs of secondary edges, one pair of secondary edges disposed adjacent each of the tip end and the tail end of the glider body.

11. A glider ski according to claim 6, wherein the at least one secondary edge forms a dihedral angle with the running surface.

12. A glider ski according to claim 11, wherein the dihedral angle is between 10° and 75°.

13. A glider ski according to claim 1, wherein the waist width is between 25 to 38 mm.

14. A glider ski, comprising:

a glider body having a tip end, a tail end, a running surface and a primary edge on each side of the running surface between the tip end and tail end, each side of the glider body having a continuous taper toward a center of the glider body from each of the tip end and tail end, defining a sidecut having a waist, the waist having a waist width less than 40 mm, a maximum width of the tip end and tail end being 20–70 mm greater than the waist width, and no part of the glider body extending past a vertical plane extending upwardly from each primary edge; and a binding platform secured to the glider body at a binding assembly mounting position over the waist, the binding platform being constructed to hold a binding assembly spaced above the glider body.

15. A glider ski according to claim 14, wherein the tip and tail have the same maximum width.

16. A glider ski according to claim 14, wherein the binding platform has a mounting portion connecting the binding platform to the glider body, the mounting portion contacting between 10–20 cm of the length of the glider body.

17. A glider ski according to claim 16, wherein a part of the mounting portion is connected to the glider body at the waist.

18. A glider ski according to claim 14, wherein the binding platform is raised between 4–7 cm above the height of the glider body.

19. A glider ski according to claim 14, further comprising at least one secondary edge connected to the glider body spaced vertically above and horizontally offset outwardly from one of the primary edges.

20. A glider ski according to claim 19, comprising a pair of secondary edges, one secondary edge spaced vertically above and horizontally outward of each primary edge.

21. A glider ski according to claim 20, wherein the pair of secondary edges are carried on a wing mounted to the glider body.

22. A glider ski according to claim 21, wherein the wing is adjustable longitudinally and pivotably relative to the glider body between the tip end and tail end.

23. A glider ski according to claim 19, comprising two pairs of secondary edges, one pair of secondary edges disposed adjacent each of the tip end and the tail end of the glider body.

24. A glider ski according to claim 19, wherein the at least one secondary edge forms a dihedral angle with the running surface.

25. A glider ski according to claim 24, wherein the dihedral angle is between 10° and 75°.

26. A glider ski according to claim 19, wherein the waist width is between 25 to 38 mm.

* * * * *